United States Patent [19]

Gray

[11] Patent Number: 5,046,641

[45] Date of Patent: Sep. 10, 1991

[54] ARTICLE DISPENSING MACHINE AND METHOD OF DISPENSING ARTICLES.

[76] Inventor: Andrew P. P. Gray, The Point, 35 Moor Lane, Copmanthorpe, York YO2 3TJ, England

[21] Appl. No.: 470,777

[22] Filed: Jan. 26, 1990

[30] Foreign Application Priority Data

Jan. 26, 1989 [GB] United Kingdom ..... 8901693

[51] Int. Cl.[5] ..... G07F 11/26

[52] U.S. Cl. ..... 221/253; 221/287; 194/283; 271/225

[58] Field of Search ..... 194/283, 286; 221/231, 221/237, 253, 279, 287; 271/34, 35, 150, 225

[56] References Cited

U.S. PATENT DOCUMENTS

| | | | |
|---|---|---|---|
| 1,767,307 | 6/1930 | Peterson | 194/283 |
| 1,891,640 | 12/1932 | Gottfried | 194/283 |
| 2,010,373 | 8/1935 | Pinkenburg | 221/253 X |
| 3,226,109 | 12/1965 | Thompson et al. | 271/34 |
| 4,106,764 | 8/1978 | Tamura | 271/35 |
| 4,667,803 | 5/1987 | Gordon | 194/248 |

FOREIGN PATENT DOCUMENTS

| | | |
|---|---|---|
| 0287795 | 10/1988 | European Pat. Off. . |
| 2117786 | 10/1972 | Fed. Rep. of Germany . |
| 58-52139 | 3/1983 | Japan . |
| 63-247229 | 10/1988 | Japan . |
| 659146 | 12/1986 | Switzerland . |
| 1110719 | 4/1968 | United Kingdom . |

OTHER PUBLICATIONS

International Application Publication WO88/00378, dated 14 Jan. 1988.

German Gebrauchsmuster G 87 03 233.3, dated 7/23/87.

*Primary Examiner*—D. Glenn Dayoan

*Assistant Examiner*—Dean A. Reichard

*Attorney, Agent, or Firm*—Watson, Cole, Grindle & Watson

[57] ABSTRACT

A dispensing machine in the form of a vending machine for vending generally planar articles, which may be rigid or flexible, includes an article feed system having a first generally horizontal conveyor on which the articles are arranged generally vertically side-by-side and by which they are moved towards a second generally transversely extending conveyor which removes the endmost article from the first conveyor and supplies it to an outlet slot in the housing of the machine and from which it is removed by the user. The second conveyor may remove articles from the first conveyor generally vertically upwardly or generally horizontally. The article feed system is driven by operation of a handle by the user through an intermediate mechanical drive system connected between the handle and the article feed system and keys may be provided for preventing operation of the article feed system in the absence of the provision by the user of the required amount of money for an article.

30 Claims, 11 Drawing Sheets

ARTICLE DISPENSING MACHINE AND METHOD OF DISPENSING ARTICLES

BACKGROUND AND SUMMARY OF THE INVENTION

The invention relates to improvements in and relating to a machine for and method of dispensing generally planar articles, which may be rigid or flexible and may be relatively thin, such for example as brochures, booklets, pamphlets, magazines, newspapers and discs for record, C.D. or video players, and particularly but not exclusively to a machine for and method of vending such articles.

According to one aspect of the present invention there is provided a method of dispensing generally planar articles comprising forming a generally horizontally extending array of the articles, the article being arranged in the array generally vertically side by side, dispensing the articles one at a time from one end of the array through a dispensing outlet, and moving the remaining articles in the array towards the one end thereof as articles are dispensed therefrom, characterised in that drivable conveyor means are provided in the path of movement of the articles in the array at the one end of the array for dispensing articles therefrom, the conveyor means comprising engagement means movable laterally of the end of the array to engage the endmost article in the array, and the conveyor means is driven to cause the engagement means to engage the endmost article in the array and dispense it through the dispensing outlet.

The generally horizontally extending array of articles may be provided on a first conveyor means which moves the articles generally horizontally, and the drivable conveyor means may form a second conveyor means which moves the articles individually from the first conveyor means to the dispensing outlet.

According to another aspect of the present invention, there is provided a machine for dispensing generally planar articles comprising a housing having an outlet through which an article is dispensed, an article feed system comprising first and second conveyor means, the first conveyor means being adapted to receive a plurality of articles and to move the articles in a first conveying direction towards the second conveyor means, the articles being arranged relative to the first conveyor means generally vertically side-by-side in the first conveying direction, and the second conveyor means being arranged to convey the endmost article of the first conveyor means in a second conveying direction transverse to the first conveying direction towards the outlet for removal therefrom, and drive means for driving the article feed system.

The first conveyor means may comprise movable endless means, e.g., one or more belts, providing a first conveying surface for supporting the articles and extending in the first conveying direction, the second conveyor means extending from the end of the first conveying surface. Article retaining means may be provided for retaining the article of the first conveyor means upright and the retaining means may be biassed in the direction of the second conveyor means.

The second conveyor means may comprise a second conveying surface extending in the second conveying direction and may comprise engagement means movable in the second conveying direction for engaging and moving the endmost article from the first conveyor means. The engagement means may be carried by endless means, e.g., one or more belts, and may be adapted to engage a lateral edge of an article or may be adapted to positively engage in the surface of the article. The engagement means may comprise a projection for engaging a lateral edge of the endmost article or one or more pins for engaging the surface of the endmost article. The extent to which the engagement means project may be adjustable.

Preferably, the first conveying direction is generally horizontal and the second conveying direction is generally perpendicular thereto. The second conveying direction may be horizontal or vertical and, when vertical, may be vertically upward.

The drive means may comprise a motor driven electrically, pneumatically or hydraulically. Alternatively, the drive means may comprise a user demand handle projecting from the housing and mounted for movement by the user from a first position to a second position in a first direction, the article feed system being coupled to the handle to be driven by movement of the handle in the first direction.

The user demand handle is preferably connected to or forms part, e.g., an end portion, of a lever which is mounted in the housing for rotation about a generally horizontal axis, rotation of the lever by movement of the handle in the first direction from its first position to its second position causing the article feed system to supply one article to the outlet.

The drive means may comprise intermediate drive means between the lever and the article feed system which includes a clutch for transmitting drive to the article feed system only when the lever is moved in the first direction, together with gear and/or chain drive means for driving the first and second conveyor means.

Biasing means may be provided for returning the handle from its second position to its first position and means, e.g., a rack or ratchet and pawl means, may be provided for preventing return of the handle to its first position until it has been moved to its second position.

The machine may be a vending machine for supplying an article to a user in response to a predetermined value of money.

The term money as used herein is intended to include actual money or items equivalent thereto such as tokens.

The machine may comprise at least one slot in the housing for money, which may be in the form of coins or tokens, and the or each slot may be associated with means for preventing operation of the machine until the correct value of money has been supplied to the machine.

The means for preventing operation of the machine in the absence of the correct value of money may comprise one or more pivotal elements, e.g., keys, which assume a first position in the absence of the correct money causing blocking of the movement of the lever and a second position in which the lever is free to move. The or each pivotal element may be pivoted to its second position by money supplied to the machine.

The or each pivotal element may be mounted to move with the handle or lever for preventing movement of the handle or lever and may be mounted on a slidable member movable with the handle or lever or may be mounted on the lever.

Stop means blocking movement of the lever may be provided in respect of the or each key, and, where a plurality of keys are provided, the or each means may be retractable to disable the key in the event that the associated money receiving slot is not required.

The machine may also comprise means for sensing the presence of articles on the first conveyor means and for preventing operation of the machine in the absence of articles thereon. These means may operate to retain the handle in a position spaced from the first position, e.g. in a position in or adjacent its second position, following dispensing of the last article on the first conveyor.

The machine may also comprise locking means to prevent movement of the handle in the first direction in the absence of supply of money to the machine, the locking means being released by insertion of one or more coins or tokens into the coin slot or at least one of the coin slots of the machine. These locking means may comprise a member movable into the path of movement of the handle or lever to prevent movement of the handle in the first direction, the member being removed from the path of the handle by insertion of money into the machine.

The machine may also comprise means for obstructing the or each coin slot in the housing when the machine is in operation.

For convenience of loading the machine, the machine may comprise a removable cassette for receiving articles, the cassette being adapted to be located on the first conveyor means and provide access for the first and second conveyor means to articles within the cassette, the cassette having an opening through which articles are dispensed by the second conveyor means.

Further features of the present invention will become apparent from the following description of embodiments thereof, given by way of example only with reference to the accompanying drawings.

DETAILED DESCRIPTION OF THE PREFERRED EMBODIMENTS

Figure 1:
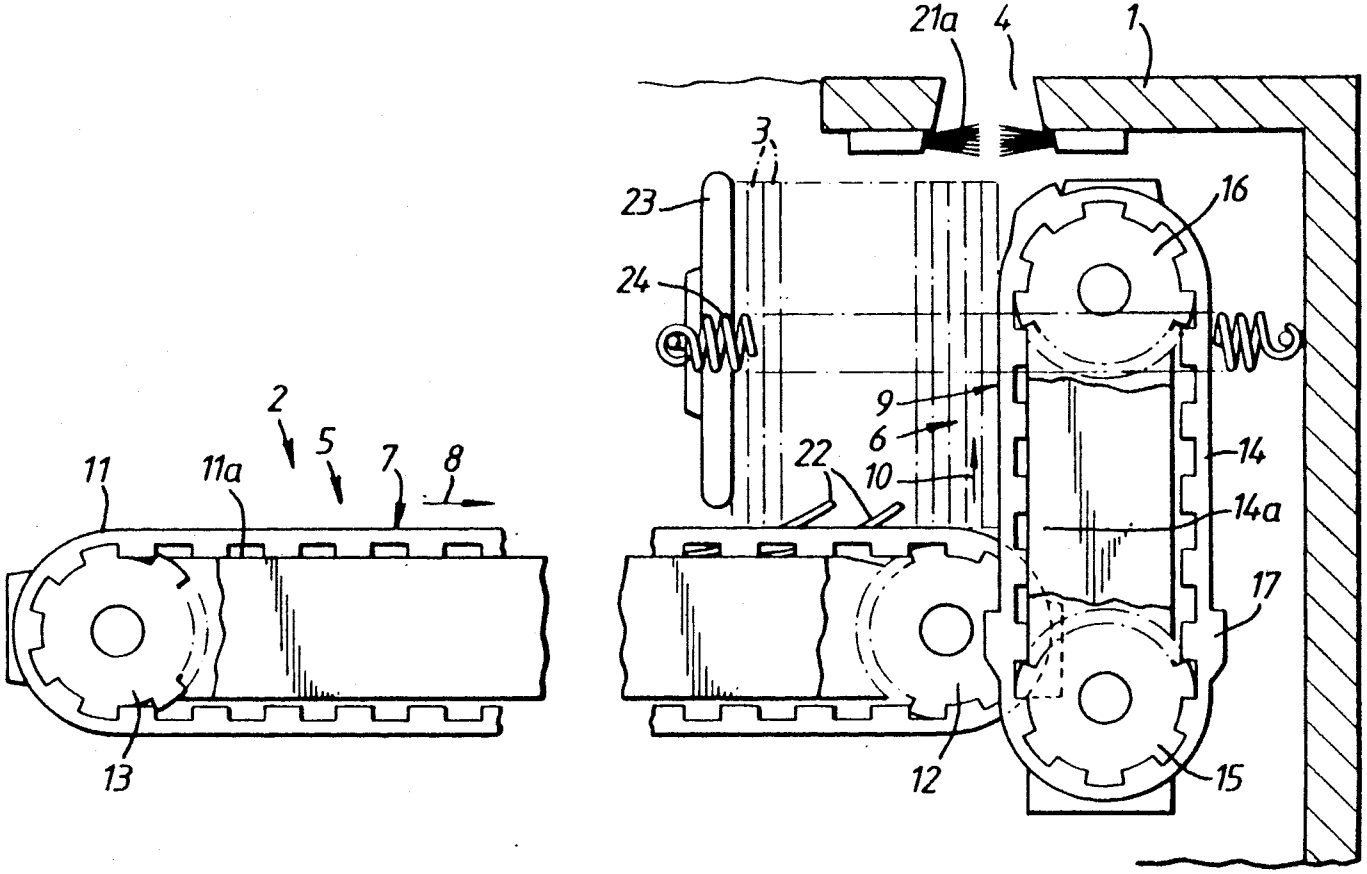
FIG. 1 is a diagrammatic side elevation of an article feed system of an embodiment according to the present invention.
Figure 2:
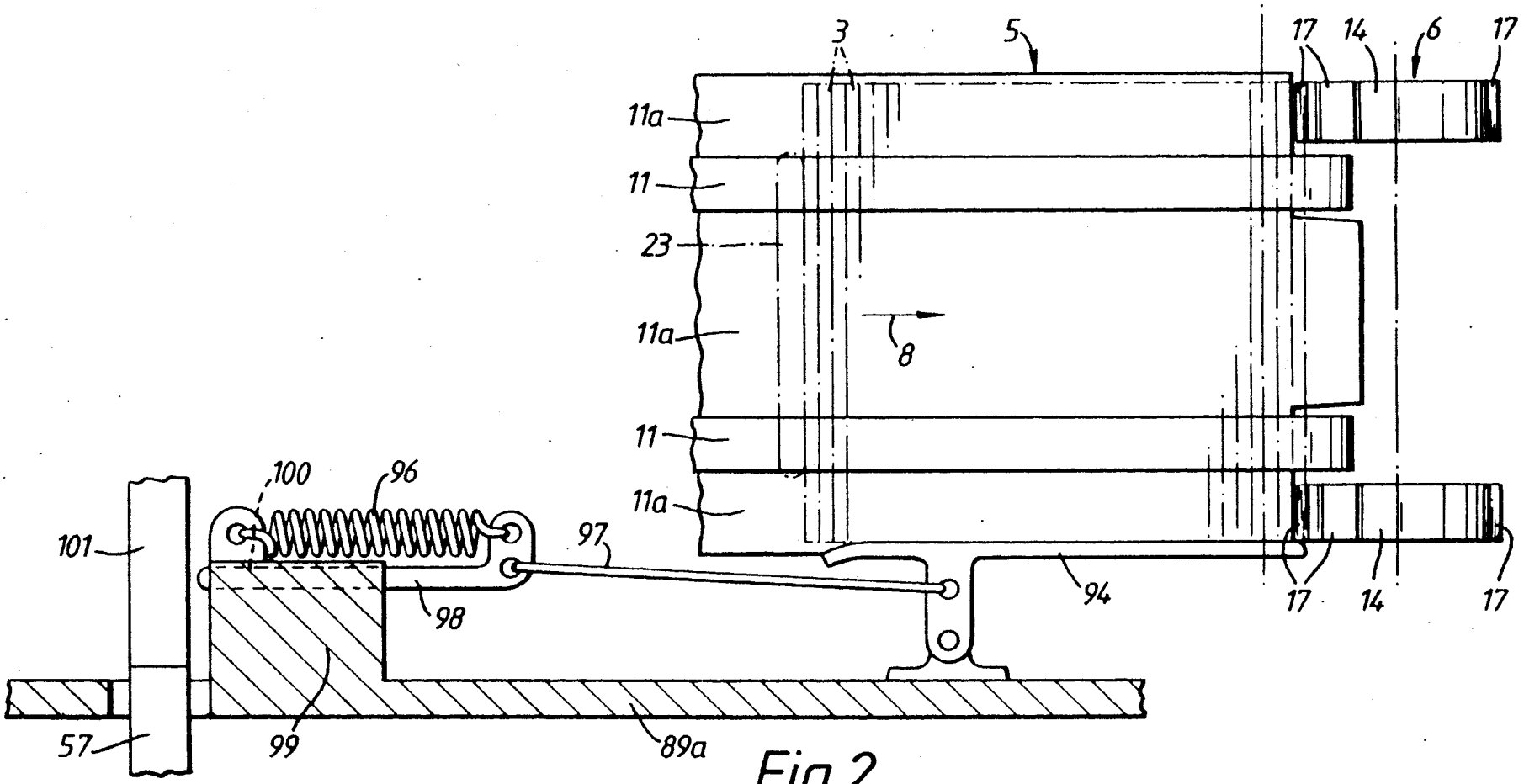
FIG. 2 is a plan view of part of the system of FIG. 1.

The embodiment of machine shown in FIGS. 1 and 2 of the drawings is a vending machine and has a generally rectangular housing 1 in which is mounted an article feed system 2 which is driven by the user to supply an article 3 to an outlet 4 in the housing for removal therefrom by the user.

As shown the machine is intended to vend relatively thin and planar articles 3 which may be flexible or rigid, such for example as brochures, booklets, pamphlets, magazines, newspapers, books or discs for record or compact disc or video players.

The article feed system comprises a first conveyor 5 and a second conveyor 6. The first conveyor 5 has a generally horizontal first conveying surface 7 for receiving a plurality of the articles 3 which are arranged on the conveying surface generally vertically side by side, and for moving the articles along the conveying surface in a first conveying direction 8 towards the second conveyor 6 which is arranged at an outlet end of the first conveying surface. The second conveyor 6 has a second conveying surface 9 extending generally transverse to the first conveying surface and along which articles are moved from the end of the first conveying surface in a second conveying direction 10 transverse to the first conveying direction 8. As shown in FIG. 1, the second conveying surface 9 extends generally perpendicularly to the first conveying surface 7 and the second conveyor is arranged to convey articles in a generally vertical direction upwardly from the end of the first conveying surface to the outlet 4.

The first conveyor 5 comprises at least one and may comprise a plurality of, as shown two, endless belts 11 extending around rollers 12, 13 of which one, e.g. roller 12, is driven. The upper runs of the belts travel over a stationary support 11*a* and provide the first conveying surface 7 on which articles are supported and along which they are moved by movement of the belts 11.

The second conveyor 6 also comprises at least one and may comprise a plurality of, as shown two, endless belts 14 extending around rollers 15, 16 of which one, which may be roller 15 or roller 16, is driven. The second conveyor 6 is arranged to pick up an article from the first conveyor 5 before the article reaches the end of the upper run of the first conveyor and while it is still supported by the first conveyor.

One run of the belts 14 travels over a stationary support 14*a* and the belts and/or the stationary support provide the second conveying surface 9. The belts 14 are provided with aligned spaced engagement means 17 for engaging the endmost article on the first conveyor to remove it from the first conveyor and convey it to the outlet 4. The engagement means 17 may take a variety of different forms depending on the articles to be engaged thereby. As shown in FIG. 1, each engagement means comprises a projection 17*a* which engages a lateral edge of the article and is appropriate where the article has a defined lateral edge, such as a booklet or disc.

Figure 3:
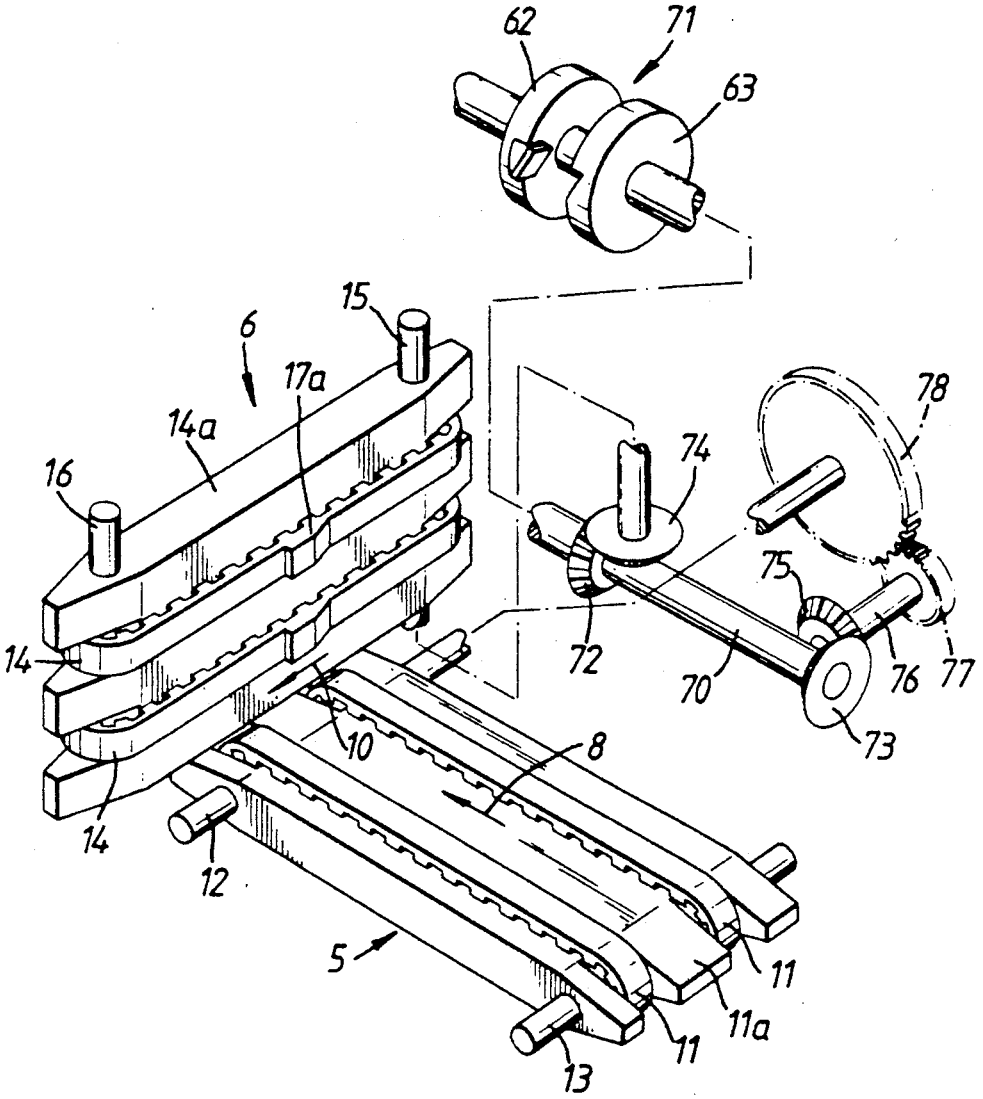
FIG. 3 is a diagrammatic perspective view of an article feed system of another embodiment according to the present invention.

An alternative arrangement of the article feed system is shown in FIG. 3 for supplying articles laterally out of the machine. The same reference numbers are used in FIG. 3 as are used in FIGS. 1 and 2 for the same or equivalent components. As in the embodiment of FIGS. 1 and 2, the embodiment of FIG. 3 comprises two conveyors 5, 6. Conveyor 5 is similar to conveyor 5 of FIGS. 1 and 2 as is conveyor 6 except that conveyor 6 is arranged to remove articles laterally and generally horizontally from the end of the first conveying surface of conveyor 5.

As in the embodiment of FIGS. 1 and 2, the belts 14 of conveyor 6 carry laterally aligned spaced engagement means 17 in the form of projections 17*a* for engaging a lateral edge of the endmost article on conveyor 5.

Figure 4:
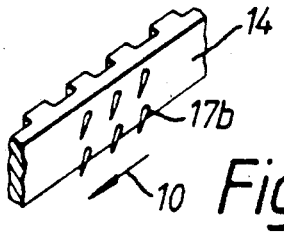
FIG. 4 is a perspective view showing a modification of part of the feed system of the embodiments of FIGS. 1 to 3.

An alternative form of engagement means 17, applicable to both embodiments, is shown in FIG. 4. As shown in FIG. 4, each engagement means 17 comprises a pin 17*b* or, as shown, a plurality of pins 17*b*, inclined in the direction of movement of the conveyor to engage in or penetrate the surface of the article to ensure positive engagement of the article. The pins 17*b* are appropriate where the lateral edge of the article is not so clearly defined as with a newspaper. As shown, the pins 17*b* will engage the endmost article at or adjacent the lateral edge of the article. It will be appreciated that the pins may alternatively be arranged to engage the article in any part of the exposed surface of the article.

Advantageously, as shown in FIG. 1, the outlet 4 is arranged immediately adjacent and in line with the second conveying direction, the end of the second conveying surface 9 and the endmost article on the first conveying surface 7, so that an article being conveyed by the second conveyor 6 is supported against the second conveying surface by the articles remaining on the first conveyor while being moved by the second conveyor towards and through the outlet 4. Depending on the spacing between the endmost article on the first conveying surface 7 and the outlet 4, retaining means may be provided for retaining articles on the second conveying surface after they have been moved clear of articles remaining on the first conveyor and before they reach the outlet 4.

Where, as in FIG. 3, the second conveyor 6 is arranged to convey articles laterally from the end of the first conveyor in a generally horizontal direction, a generally horizontal support surface may be provided for supporting the lower edge of the article being conveyed by the second conveyor. This may be unnecessary if the lateral extent of the first conveying surface is sufficient to adequately support the article in its lateral movement to the outlet 4.

Where projections 17*a* are provided, the projections should extend from the surface of the belts a distance less than the thickness of one of the articles. To enable the machine to be used for articles of different thicknesses, the one run of the belts 14 may be arranged behind the surface of the stationary support means, which define the second conveying surface, and through which the projections project to an adjustable extent. Such an arrangement may also be provided where other forms of engagement means are used. Where engagement pins 17*b* are provided, the second conveyor may be arranged with the roller 15 aligned with the lateral edge of the article to be engaged by the pins or inwardly of the lateral edge so that as the parts of the belts carrying the pins leave the roller 15 they progressively engage the exposed surface of the endmost article on the first conveyor adjacent or inwardly of its lateral edge.

Figure 6:
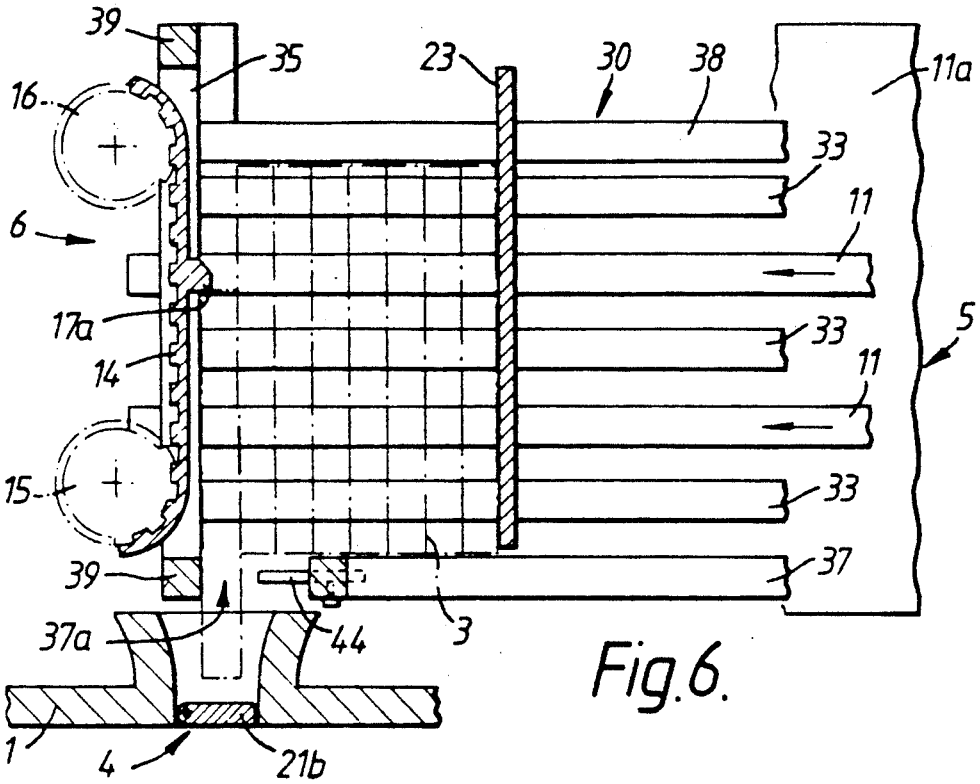
FIG. 6 is a horizontal section through the cassette of FIG. 5 in use and showing parts of the article feed system of FIG. 3.

The outlet 4 is in the form of a slot in the housing which may be provided with a closure means 21. The closure means may, as shown in FIG. 1, be in the form of brushes or bristles 21*a* extending across the slot from each edge. Alternatively, for reasons of security, the outlet slot may be provided with a non-return closure means 21*b*, e.g. in the form of a hinged spring biassed flap 21*b*, as shown in FIG. 6, which is opened by an article being dispensed, will automatically close following dispensing of the article and cannot be opened from the outside of the machine. Locking means, e.g. in the form of a spring biased bolt (not shown), may be provided for preventing the door 21*b* being opened when the machine is not being operated.

In each operation of the machine, the driven roller 12 of the first conveyor 5 is rotated in a direction to move articles on the first conveyor a distance at least equal to the thickness of an article. The distance may be greater to ensure that the articles are maintained with the endmost article at the end of the first conveying surface ready for engagement by the second conveyor. The driven roller of the second conveyor 6 is rotated in a direction to cause one pair of aligned engagement means 17 to engage and move the endmost article on the first conveyor through the outlet 4 and bring the succeeding engagement means 17 to a position ready to engage the next article on the first conveyor. The driven rollers may be coupled together by any suitable means such as gears and/or chains to be driven by common drive means.

To reduce the friction between articles on the first conveyor 5 and the belts 11 at least as the articles approach the second conveyor 6, the first conveyor 5 may be provided with resilient article supporting strips 22 (FIG. 1) which project into path of the articles at least adjacent the end of the first conveying surface, to slightly lift the articles off the belts 11. The progressive lifting of the articles by the strips 22 also has the effect of breaking any adhesion between adjacent articles.

Articles on the first conveyor 5 are held upright and lightly urged in the direction of the second conveyor 6 by a retaining plate 23 (shown in FIG. 1 but not shown in FIG. 3) located behind the rearmost article. The plate 23 is provided with a constant bias in the direction of the second conveyor by constant tension spring devices 24 (shown diagrammatically in FIG. 1) connected one to each side of the plate 23 and, as shown in FIG. 1, to the housing 1.

The conveyors 5, 6 are in both embodiments conveniently mounted in an upper part of the casing 1 to be accessible from the top of the casing which is made openable, for replenishing the supply of articles supported on the first conveyor 5.

Figure 5:
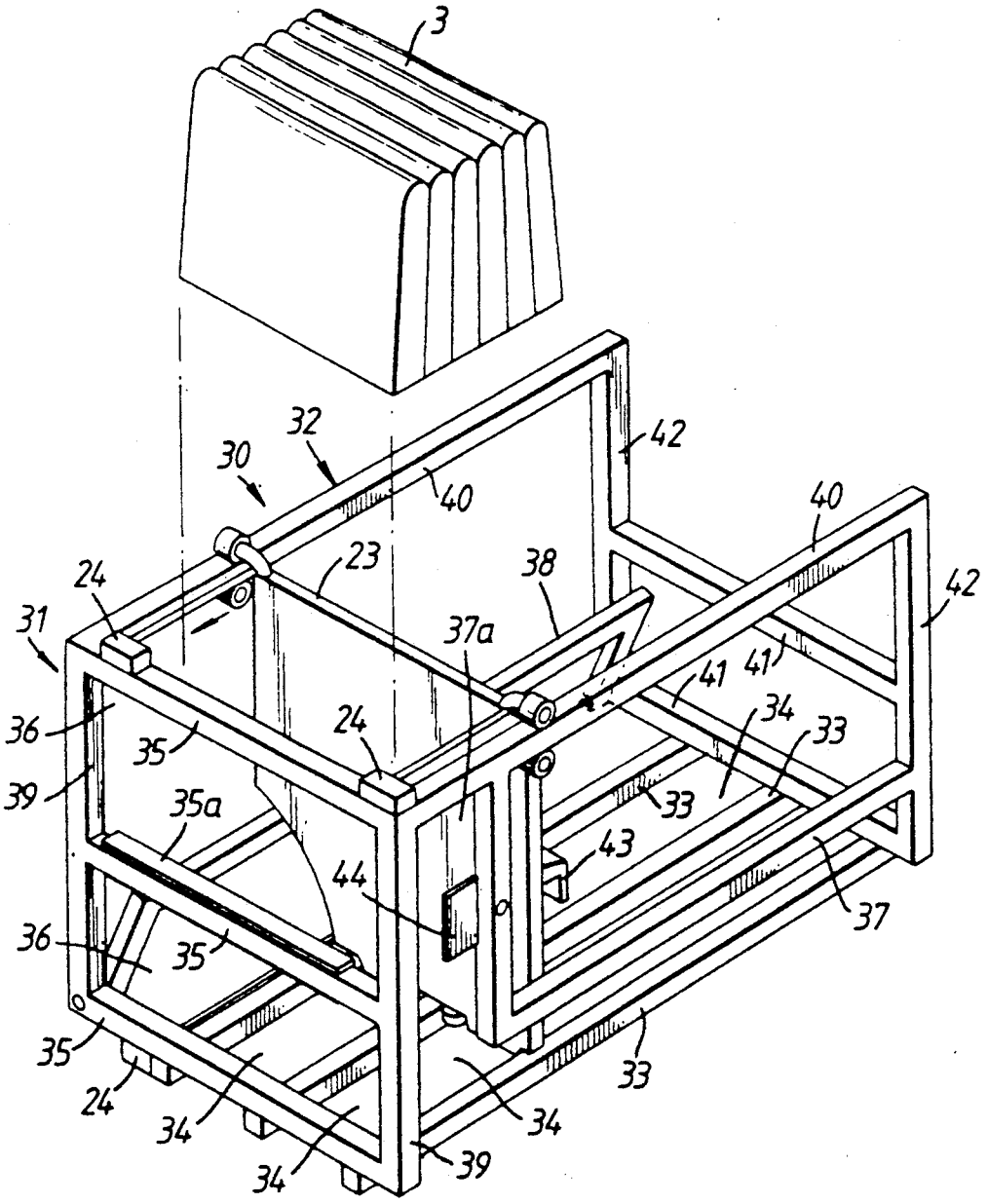
FIG. 5 is a perspective view of an embodiment of a cassette for use with the embodiment of FIG. 3.

For convenience of filling, the machine may be adapted to receive a cassette 30 which is pre-filled with articles to be dispensed and is, when filled, positioned on the first conveyor with its front end 31 against the second conveyor. Such a cassette for use with the embodiment of FIG. 3, is shown in FIGS. 5 and 6. The cassette 30 comprises an open topped frame 32 within which the articles are received. The base of the frame comprises lengthwise members 33 which are received in corresponding slots (not shown) in the stationary support 11*a* for the belts 11. The slots in support 11*a* and members 33 extend adjacent and parallel to the belts 11 so that the belts 11 extend into the gaps 34 between the members 33 and engage the articles 3 in the cassette. Similarly, at the front end 31, the frame has members 35 which extend parallel to the belts 14 and the second conveying direction 10 and provide gaps 36 into which the engagement means 17 on the belts 14 extend to engage the endmost article on the first conveyor. On that side of the cassette from which an article is dispensed, the frame includes an L shaped lateral frame member 37 which terminates short of the front end 31 and defines a slot 37*a* through which an article is dispensed from the cassette. On the other side there is a lateral member 38 which is pivotally mounted on the cassette and adjustable inwardly of the cassette to maintain the articles in the cassette butted up against the other side of the cassette so that they are in the correct position for engagement by the engagement means 17 of the second conveyor. The frame includes other vertical and horizontal members 39 at the front end, 40 at the sides and 41 and 42 at the rear to brace and strengthen the cassette.

The cassette may include the retaining plate 23 which is then mounted for sliding movement on frame members 33 and 40 and is biassed lightly in the forward direction by constant tension spring devices 24 connected between the upper and lower edges of the plate 23 and the front frame members 35 of the cassette. The plate 23 may have a rearwardly extending hook 43 for hooking over frame member 41 while the cassette is being filled. To ensure that only one article is dispensed in each operation of the machine, an adjustable stop 44 may be provided on frame member 37 and which extends to an adjustable extent across the slot 37*a*. The stop 44 is arranged so the gap between its forward edge and the front frame member 39 is slightly greater than the thickness of a single article but less than the thickness of two articles.

In use of the cassette, as shown diagramatically in FIG. 6, the front 31 of the cassette is butted up against the second conveyor 6. Depending on the extent to which the engagement means project from the second conveying surface, the support 14*a* for the belts 14 of the second conveyor may be provided with slots similar to those provided in support 11*a*, for receiving the frame members 35 to enable the engagement means 17 to extend through the gaps 36 and engage the endmost article in the cassette. The second conveyor 6 is arranged to be of a length to fit between the frame members 39 without interference between the frame members and the engagement means. If it is required for the second conveyor to extend in the second conveying direction laterally beyond the articles in the cassette, the frame of the front end 31 may be laterally extended beyond the main part of the frame of the cassette.

The frame members 35 may be provided with adjustable means 35*a* for adjusting the spacing between the endmost article in the cassette and the engagement means 17. It will be appreciated that, using the cassette, the conveying surface of the second conveyor is in effect defined by the frame members 35 defining the front end of the cassette.

For use with the machine as shown in FIG. 1, the cassette shown in FIG. 6 is modified to enable articles to be dispensed vertically upwardly from the cassette.

Figure 6A:
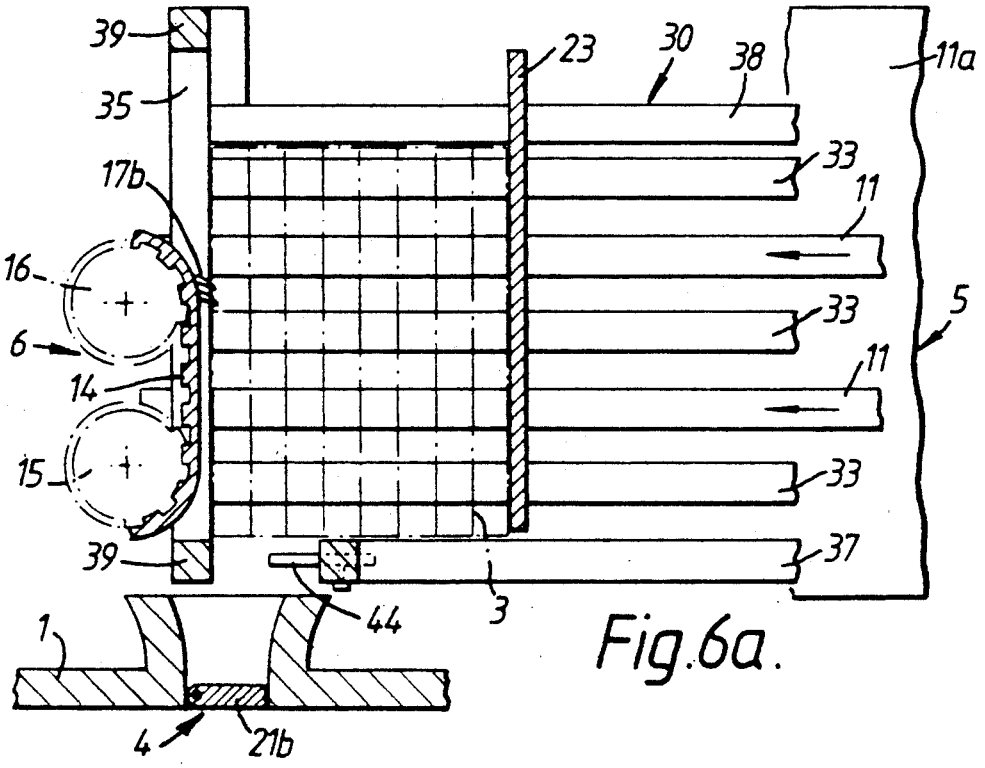
FIG. 6*a* is a view similar to that of FIG. 6 showing a modification of the second conveyor.

FIG. 6*a* shows a modification of the arrangement of FIG. 6 which is applicable where the engagement means 17 of the second conveyor do not engage the lateral edge of the endmost article 3 on the first conveyor, e.g. where the second conveyor 6 has engagement pins 17*b*. As shown, the operative run of the belts 14 of the second conveyor is reduced in length and its length is related to the distance an article 3 has to travel from the end of the first conveyor to project through outlet 4. The operative run of the belts 14 is just long enough to ensure that the article 3 will be conveyed by the engagement pins 17*b* from the end of the first conveyor towards the outlet 4 to project through outlet 4 sufficiently to be grasped by the user of the machine. This arrangement is advantageous because, with a reduced distance of travel of the pins 17*b* they can travel more slowly in each operation of the machine thus reducing the risk that the pins 17*b* could tear the surface of the article. Additionally, with a longer belt run, as in the embodiment of FIG. 6, there is a risk that two articles could be dispensed in one operation of the machine, if the user grasps the first article as soon as it appears in the outlet and forcibly removes it from the machine. The pins 17*b* engaging that first article may then engage the succeeding article and, with continued movement of the second conveyor, this succeeding article could be moved as far as the outlet and be grasped by the user.

The modification shown in FIG. 6*a* is equally applicable to the embodiments of FIG. 1, 2 and 3. In these embodiments, and indeed in the embodiment of FIG. 6*a*, the support 14*a* of the second conveyor may be extended beyond the ends of the belts to provide a support surface against which the endmost article on the first conveyor is supported before being engaged by the pins 17*b*, to ensure that the endmost article on the first conveyor is supported across its full height, for the embodiment of FIGS. 1 and 2, and full width for the embodiments of FIGS. 3 and 6*a*. Such an extension is not required in the embodiment of FIG. 6*a* because the endmost article on the first conveyor is supported by the frame members 35 of the cassette, but may be desirable as an aid to correct location of the cassette.

Figure 7:
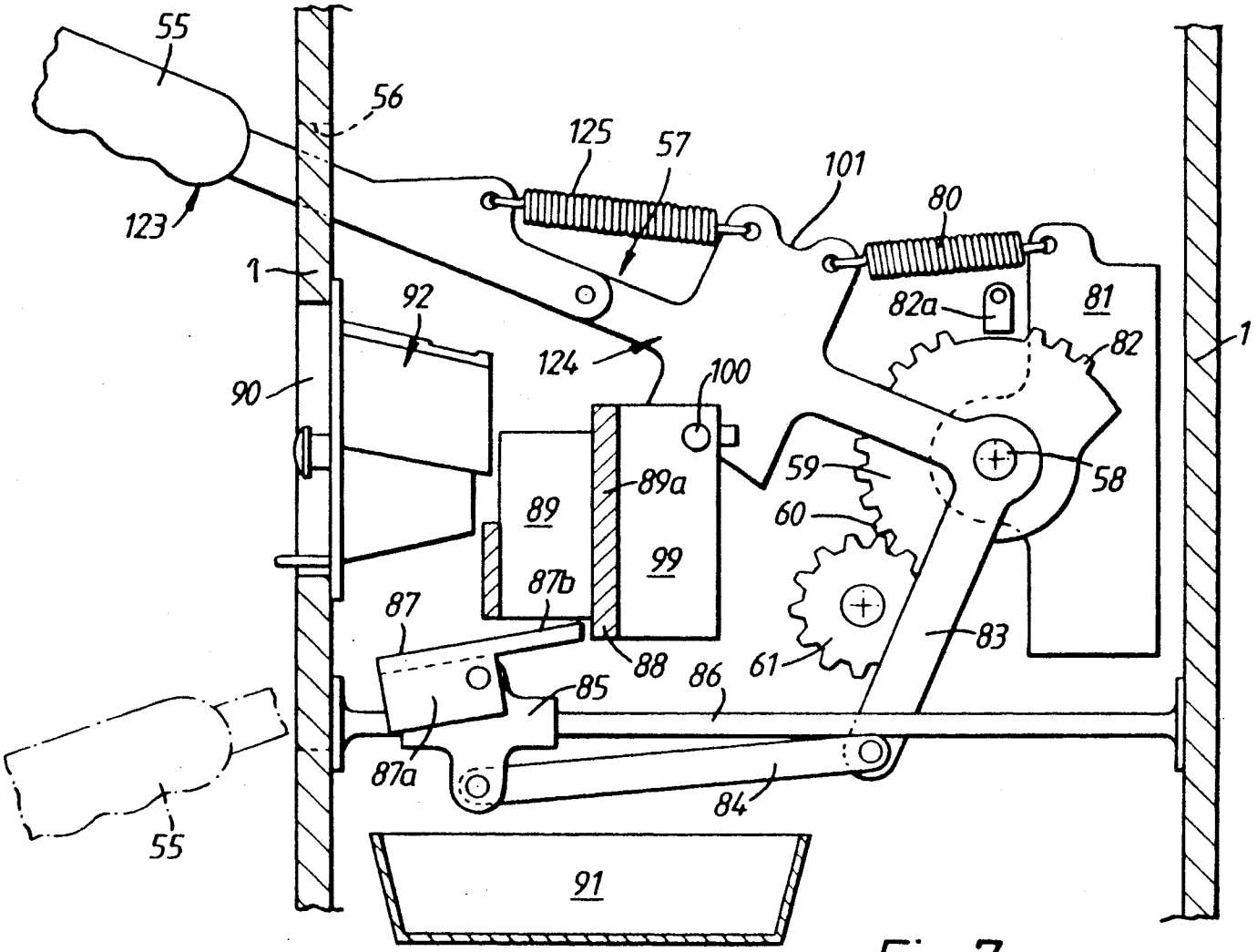
FIG. 7 is a part sectional part elevational view of part of the drive mechanism for an article feed system of an embodiment according to the present invention.

The conveyors 5, 6 of both the above described embodiments are driven by manual operation, by the user, of a handle 55 (FIG. 7) projecting from the housing 1 through a slot 56, the handle forming part of drive means connected to drive the driven rollers 12 and 15 or 16 of the conveyors. As shown in FIG. 7, the handle 55 is arranged to be moved in a vertical plane from an initial upper position (as shown in solid lines in FIG. 7) to a lower position (indicated by broken lines in FIG. 7) to drive the conveyors. The handle forms one end of a lever 57 which is pivotally mounted in the casing on a shaft 58 which drives the rollers 12, 15 through clutch means preventing reverse rotation of the rollers as the handle is returned from its lower position to its initial upper position. The output end of the clutch means may be connected directly or through gear and/or chain drive means to drive the rollers 12, 15.

Figure 8:
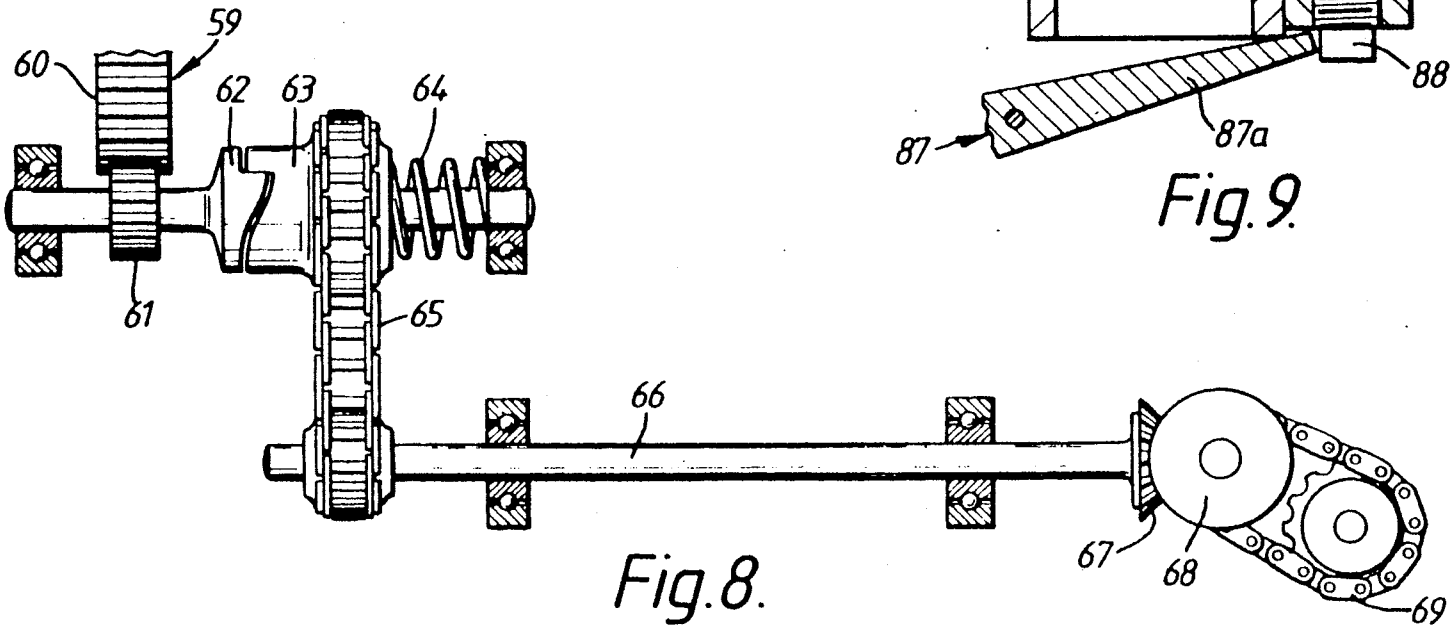
FIG. 8 is an elevation perpendicular to the elevation of FIG. 7 showing the remainder of the drive mechanism for the embodiment of FIGS. 1 and 2.

As shown in FIGS. 7 and 8 for the embodiment of FIGS. 1 and 2 in which the axes of the driven rollers of the conveyors are parallel, the shaft 58 is mounted in the housing in bearings and carries a gear 59 with teeth 60 which mesh with a toothed cog wheel 61. The cog wheel 61 is mounted on the shaft of one part 62 of a single toothed dog clutch, the other part 63 of which is urged into engagement with the first part by a spring 64 and which is arranged so that rotation of the one part 62 in one direction only is communicated to the second part 63 of the clutch. A chain 65 or gear system connects the second part of the clutch to one end of a shaft 66 mounted in bearings and which carries at its other end a gear 67 meshing with a gear 68 mounted on the shaft of the roller 12. As shown, roller 15 is driven from gear 68 by a drive chain 69 but may be driven through gears which allow for differing movements of the two conveyors. For the embodiment of FIG. 3 in which the axes of the driven rollers of the conveyors are perpendicular, an appropriate gear train may be interposed between gear 68 and roller 15.

Alternatively as shown in FIG. 3, movement of lever 57 in the first direction may cause rotation of a shaft 70 via a single tooth clutch 62, 63. Shaft 70 carries two bevel gears 72, 73. Gear 72 meshes with gear 74 on the shaft of roller 15. Gear 73 meshes with gear 75 on a shaft 76 which carries a gear 77 which meshes with gear 78 on the shaft of roller 12. The gearing is arranged to provide appropriate movements of the two conveyors.

Where a single tooth one way clutch is used, movement of the lever between its initial and fully lowered positions must cause a 360° rotation of the first part 62 of the clutch. By using a multitooth one way clutch, gear wheels 59 and 61 may be omitted and the first part of the clutch may be connected directly to the shaft 58 of the lever to be driven directly by the lever. The full angular movement of the lever must then be arranged to be a whole number fraction of 360° and the number must be equal to the number of teeth of the clutch. For example, for a six toothed clutch, the full angular movement of the lever 57 between its initial and fully lowered positions must be 60°.

The handle 55 is returned from its lower position to its initial position by a return spring 80 and the shaft may be provided with a damping unit 81 for preventing excessively fast movements of the handle both downwardly and upwardly. For correct operation of the conveyors each time the handle 55 is operated, the handle must be fully depressed each time. Means may be provided to ensure that this occurs. For example, as shown in FIG. 7, the gear 59 on shaft 58 may carry a second set of teeth 82 which are engaged by a ratchet 82*a* or other detent which acts to prevent return of the handle unless it has been fully depressed and the ratchet 82*a* has passed the last of the teeth 82.

Locking means are provided to prevent operation of the machine in the absence of the required predetermined value of money. The locking means may prevent movement of the lever 57 in the absence of the predetermined value of money. Where the machine is coin or token operated, the locking means may comprise a pivotal key which is pivotable between a locking position preventing movement of the lever 57 and a free position in which the lever can move, the key being pivoted between its two positions by a coin or token inserted in the machine. The key may be mounted for movement with the lever either on the lever or on a component moved with the lever and may act directly on the lever in its locking position or may indirectly prevent movement of the lever. In the mechanism shown in FIG. 7, the key is mounted on a component moved with the lever. As shown, the lever 57 carries an extension 83 making the lever generally L-shaped. The end of the extension is pivotally coupled to a rod 84 which is pivotally coupled to a carriage 85 slidable along a bar 86 mounted in the housing. The key 87 is pivotally mounted on the carriage 85 to tilt between its locking position and its free position. The key 87 is located adjacent one end of the bar 86 (as shown in FIG. 7) when the lever 57 is in its initial position. When the key is in that location and in its locking position (shown in FIG. 7), the key 87 abuts a stop 88 preventing movement of the carriage 85 along the bar 86 and therefore preventing movement of the lever 57. In the free position, the key 87 is clear of abutment with the stop 88 permitting movement of the carriage 85 and of the lever 57. A force is applied to one end 87*a* of the key 87 to hold it in its locking position at least when the key is in the location shown in FIG. 7. In this location, the other end 87*b* of the key is positioned below a channel 89, through which a coin or token fed into the machine through a coin or token slot 90 in the housing, falls so as to tilt the key 87 to its free position against the holding force.

The holding force on the key 87 may be provided by a weight or spring or magnetic attraction and may be adjustable to enable the machine to be operated by different weights of, e.g. different numbers or types, of coins or tokens.

Figure 9:
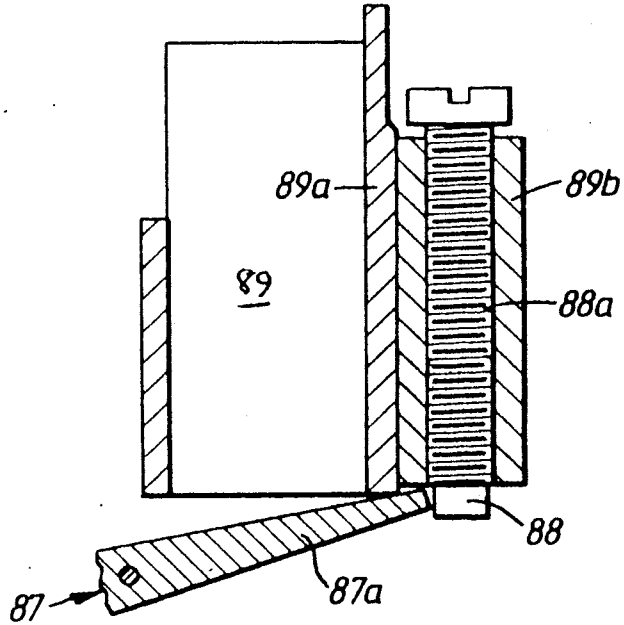
FIG. 9 is a sectional view showing a modification of FIG. 7.

As shown, the stop 88 is provided by the lower edge portion of a wall 89*a* in part defining the channel 89. When the key 87 has been tilted to its free position and the lever 57 is moved towards its lower position, the key 87 and carriage 85 is moved away from the lower end of the channel 89 permitting the coin or token to fall into a coin receiving tray 91. The key 87 may then tend to tilt back to its locking position but this will not prevent continued movement of the lever to its lower position and back to its initial position. When the lever 57 has returned to its initial position and the carriage 45 has returned to its initial position, the key 87 will then return to an effective locking position (as shown in FIG. 7). The machine may be provided with a plurality of coin or token receiving slots 90 for receiving coins or tokens of different value, e.g. 10 p, 5 p, 2 p and 1 p coins. Each slot is then associated with a channel 89 and a key 87 whose holding force is adjusted to the coin(s) or token(s) to be received by the respective slot, so that the respective key is tilted to its free position only by the correct number of coin(s) or token(s). The keys 87 are individually pivotally mounted on a common carriage 85 and have individual stops 88. To enable adjustment of the machine to operate with varying combinations of coins or tokens but not necessarily coins or tokens of all values provided for, each key may be adapted to be disabled, for example by retraction of the associated stop. As shown in FIG. 9, each stop 88 is provided by the lower end of a threaded member 88*a* threaded into a housing 89*b* mounted on wall 89*a* to be individually retractable to disable the associated key and permit the lever 57 to move when that key is in its locking position. With such an arrangement, only when the correct value of money has been received and all the operative keys 87 are in their free positions, will the lever 57 be able to move.

Figure 7A:
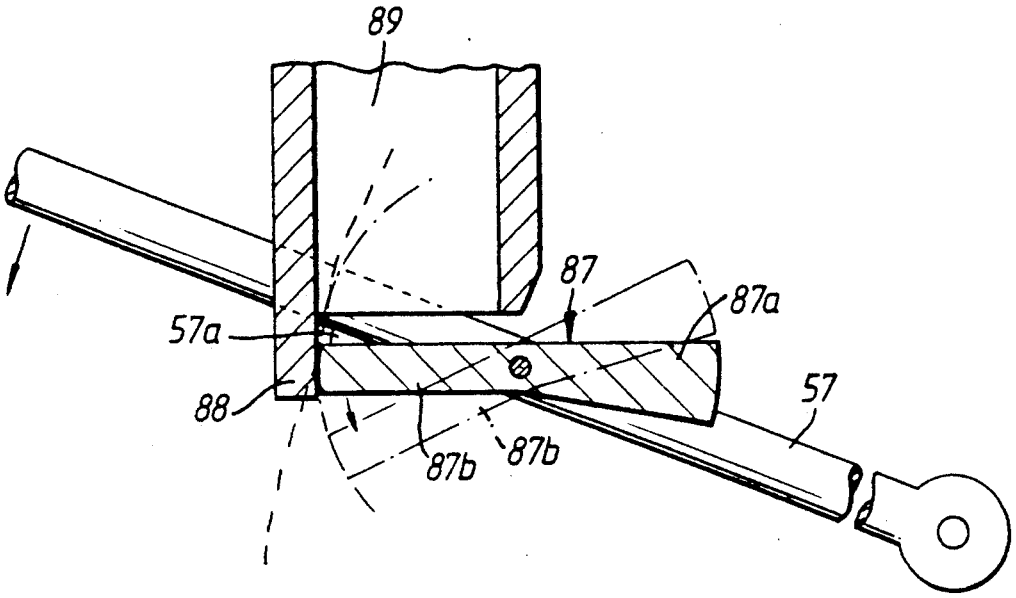
FIG. 7*a* is a sectional view showing a modification of part of the mechanism of FIG. 7.
Figure 7A:
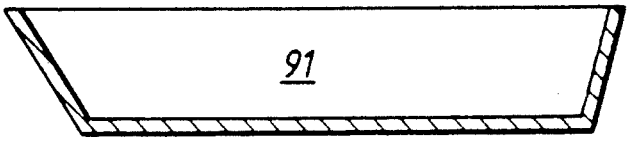

An alternative arrangement of the or each key 87, in which the or each key is mounted on the lever 57, is shown in FIG. 7*a*.

As in the embodiment of FIG. 7, the or each key 87 is pivotally mounted for movement between a locking position (as shown full lines in FIG. 7*a*) in which the free end of part 87*b* abuts a stop 88 so as to prevent movement of the lever 57, and a free position (shown partially in broken lines in FIG. 7*a*) clear of the stop and permitting the lever to move, the or each key being arranged to be tilted by one or a predetermined number of coins or tokens supplied to the machine.

As shown in FIG. 7*a*, the key 87 is pivotally mounted on and laterally of the lever 57 so as to pivot in a plane parallel to the plane of angular movement of the lever. In the locking position of the key, the free end of part 87*b* is aligned with or, as shown, below the level of the lever in its initial position and the surface of the stop 88 against which it is abutted is substantially perpendicular to the end of the key. Conveniently, as shown in FIG. 7*a*, the key is generally horizontal in its locking position.

One key 87 may be provided on each side of the lever and the or each key is arranged with its part 87*b* below a coin channel 89. A force, as previously described, is applied to part 87*a* of each key to hold or bias the key in or to its locking position. The stop 88 is provided by the end of a wall of the associated coin channel but may be as described with reference to FIG. 9.

Clockwise or anticlockwise movement of the or each key from its locking position to a position clear of the stop 88 would enable the lever to move. In this embodiment, clockwise movement of each key is prevented either by the lower end of the associated coin channel or, as shown, by a stop 57*a* on the lever. Anticlockwise movement of each key is caused by a coin or token or a predetermined number of coins or tokens falling onto part 87*b*. Pivotal movement of the key in the anticlockwise direction is limited by a further stop (not shown) which is positioned so that the coin(s) or token(s) are retained in the coin channel and bearing on part 87*b* of the key to hold the key in its free position until the lever is moved downwardly from its initial position. The coin(s) or token(s) are then released from the channel to fall into a tray 91.

As previously mentioned, two keys may be provided each associated with a coin channel. The lever 57 is then arranged to move through a gap between the coin channels and the associated coin slots in the housing are arranged one on each side of the lever slot.

It will be appreciated that incorporation of the modification of FIG. 7*a* in the mechanism of FIG. 7 would enable components 83, 84, 85 and 86 to be omitted.

The machine may be provided with money validation means 92 associated with the or each coin slot. The money validation means may comprise money acceptance means for ensuring that each coin or token fed into a slot 90 in the machine is the correct type of coin or token for that slot. The keys 87 then serve to ensure that the correct number of the different types of coins or tokens is fed into the machine before the machine will operate.

In a modification, the money validation means may also comprise money valuation means to ensure that the correct amount of money has been fed into the machine. If both money acceptance and money valuation means are provided then a single key 87 may be provided which is arranged so that it will be tilted to its free position by any acceptable coin or token which is released from the money validation means into the associated channel 89.

The money validation means 92 is mounted in the housing with its inlet or inlets arranged to receive coins or tokens from the or each slot 90 in the housing and with its outlet or outlets above the or each channel 89.

Money acceptance and money valuation means are well known and, by way of example, may be as sold by Coin Control Ltd or EDR Muller Ltd.

It will be appreciated that the locking means for preventing movement of the lever 57 in the absence of the correct value of money may take a variety of different forms other than that described above, and specifically may be released by means other than the presence of a coin or token. For example, the locking means may be released directly by the valuation means, if provided. Equally the machine may be arranged to be operated by payment in other forms than coins or tokens, e.g. by the use of a cash card, and the locking means would then be operated by the card accepting mechanism.

The machine may also be provided with means for disabling the drive means in the event that no article remains to be dispensed. The disabling means may include means for sensing the presence of articles on the first conveyor and which may for example close the coin slots or prevent return of the lever 57 to its initial position, after the last article has been dispensed. Such an arrangement is shown in FIG. 2 and is equally applicable to the embodiments of FIGS. 3, 6 and 6*a*. As shown in FIG. 2, the article sensing means comprises a feeler bar 94 which is pivotally mounted on wall 89*a* and is biassed by a spring 96 to a first position in contact with articles on the first conveyor. The bar is connected by a tie 97 to a rod 98, the spring 96 being connected between the rod 98 and an ear projecting from a member 99 mounted on the wall 89*a*. The rod 98 extends through an opening 100 in the member 99 perpendicularly to the plane of movement of the lever 57 and is arranged to be aligned with a notch 101 in an intermediate portion of the lever 57 when the lever is in its lower position. The rod 98 remains out of the path of the lever so long as the bar 94 is in its first position and there are articles on the first conveyor. When the lever 57 is depressed and dispenses the last article on the first conveyor, the bar 94 pivots anti-clockwise as viewed in FIG. 2 which allows the rod 98 to move into the path of the lever and prevents the return of the lever to its initial position.

Figure 10:
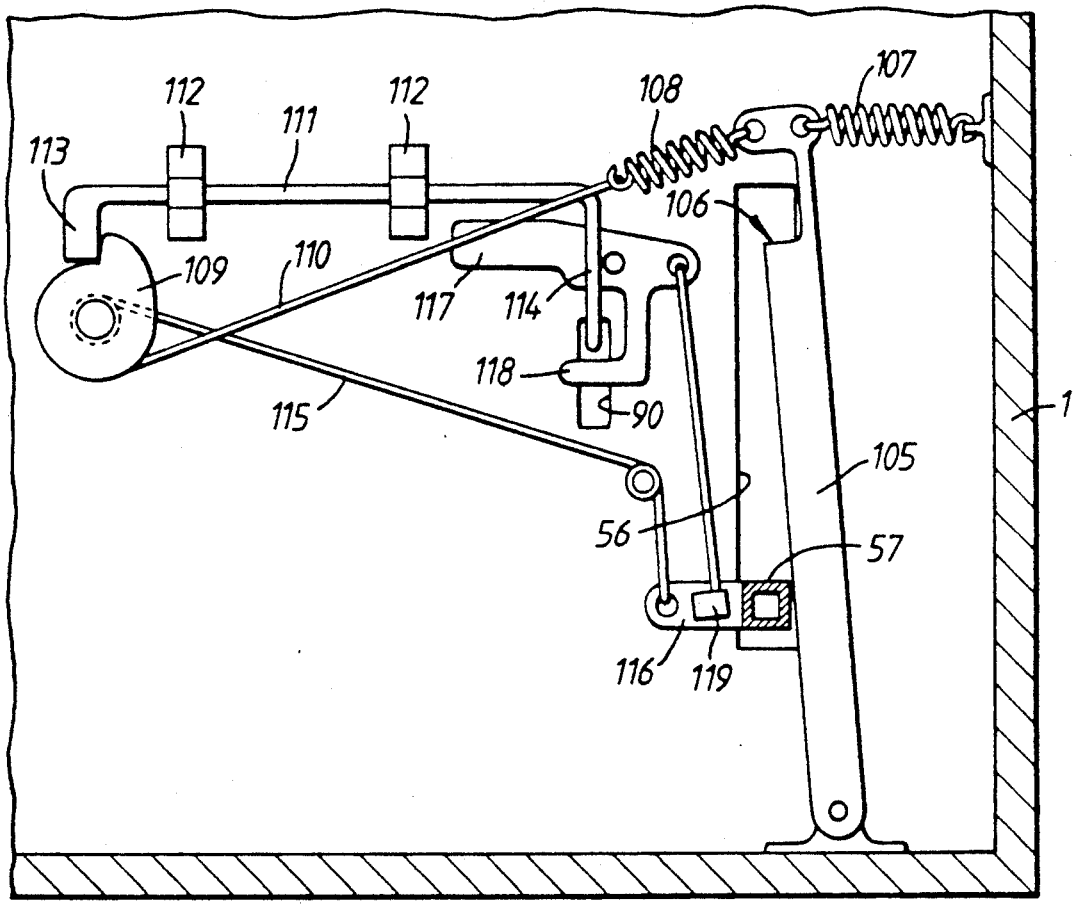
FIG. 10 is an elevational view of mechanisms associated with the handle for preventing operation of an embodiment according to the present invention.

The machine may include second locking means for preventing movement of the lever from its initial position in the absence of supply of a coin or token to the or one of the coin slots 90. Such means may comprise a sensor associated with the coin slot which is coupled to means blocking movement of the lever and which causes removal of the block on movement of the lever when a coin is inserted into the coin slot. Such an arrangement is shown in FIG. 10. As shown, an arm 105 is pivotally mounted on the base of the housing and is movable between a position alongside the lever slot 56 and a position partly across the slot 56. At its upper end the arm 105 has a notch 106 in which the lever 57 can locate when the lever is in its initial position. The arm is subject to opposing forces of two springs 107, 108, one spring 107 being connected to the housing and the other spring 108 being connected to a ratchet pulley 109 by a cord 110. With the pulley in the position shown in FIG. 10, the arm 105 is biassed by spring 108 to a position across the slot and, when the lever 57 is in its initial position, the lever 57 will engage in the notch 106 and will thereby be held in its initial position. A rod 111 is pivotally mounted in bearings 112 on the housing adjacent the coin slot(s) 90 and carries at one end a lug 113 which, when the pulley is in the position shown in FIG. 10, engages the ratchet to hold the pulley 109 in that position. When the lug is in a position engaging the pulley, a finger 114, at the other end of the rod 111, extends across the coin slot 90. When a coin or token is introduced into the coin slot it contacts and pivots the finger 114 out of its way. This rotates the rod 111 which causes the lug 113 to disengage from the pulley 109 permitting the pulley to rotate to relieve the tension in the spring 107 so that the arm 105 returns to a position alongside the slot and the lever 57 is freed from the notch 106 so enabling the lever 57 to be moved.

The pulley 109 is also connected by a cord 115 to a lateral arm 116 on the lever 57, the cord 115 being tensioned as the lever approaches its lower position to cause the pulley to be rotated back to the position shown in FIG. 10 to permit re-engagement of the lug 113 with the ratchet. This also tensions the spring 107 pivoting arm 105 back across the slot 56 and permits the finger to return to a position across the coin slot. Return of the lever 57 to its initial position is not prevented by the arm 105, which is moved by the lever out of the path of the lever against the bias of spring 108 until the lever registers with and engages in the notch 106. It will be appreciated that where a plurality of coin slots 90 are provided, a corresponding number of individual fingers 114 may be provided on the rod 111.

FIG. 10 also shows means for preventing insertion of a coin or token into the machine when the lever 57 is not in its initial position. As shown a member 117 provided with a finger 118 is pivotally mounted on the housing for movement in a plane parallel to the housing wall. The pivot point of the member is off-set from its centre of gravity and the member is connected by a spring 119 to the lateral arm 116 on the lever. When the lever is in its initial position, the member pivots under gravity to a position clear of the coin slot 90. As the lever 57 moves from its initial position, the spring 119 is tensioned and pivots the member to bring the finger 118 to a position across the slot 90 preventing insertion of a coin or token into the slot. Where a plurality of slots 90 are provided a single or individual members 117 may be provided for the slots 90. In a modification, the or each member 117 may be replaced by a slidable spring biased bolt arranged to move or be moved linearly across the slot 90 as the lever 57 moves from its initial position.

To prevent damage to the mechanisms of the machine resulting from excessive force on the handle, for example when movement of the handle is prevented, the lever 57 is in two parts, an outer part 123 providing the handle 55 and an inner part 124 mounted on shaft 58, the two parts being pivotally connected together with a strong spring 125 holding the two parts rigid for normal use. Excessive force on the handle will overcome the spring 125 but for all normal purposes the handle acts as one with the rest of the lever.

Figure 11:
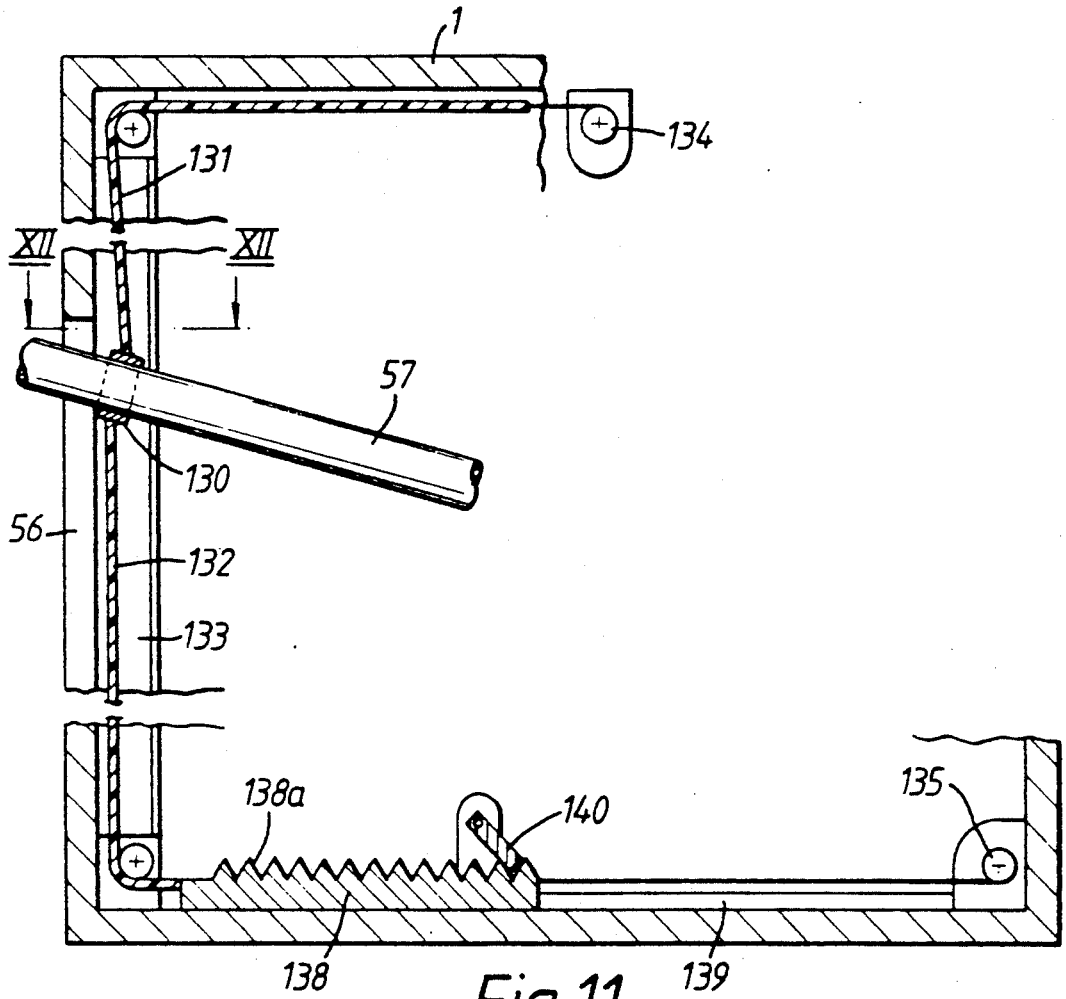
FIG. 11 is a vertical sectional view through the housing of an embodiment according to the invention showing the lever and means associated therewith.
Figure 12:
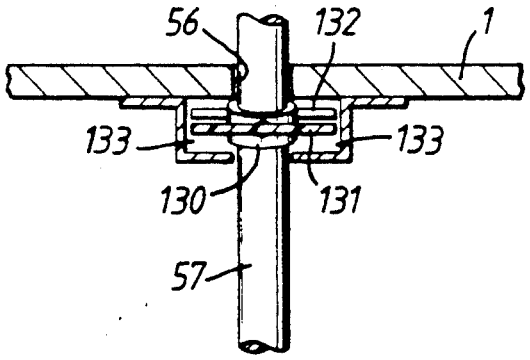
FIG. 12 is a section on the line XII—XII of FIG. 11.

For reasons of security, particularly as in the modification of FIG. *7a* where the coin mechanisms are adjacent the lever slot 56, means may be provided for closing the lever slot above and below the lever. As shown in FIGS. 11 and 12, the lever may be provided with a collar 130 slidable freely thereon and attached on either side of the lever to a flexible band 131, 132, e.g. of a plastics material reinforced with glass fibres or metal, which extends across the lever slot to close it. The edges of the bands are retained and guided in C-shaped channels 133 located on each side of the slot 56. The ends of the bands are attached to constant tension spring mechanisms 134, 135 mounted in the housing, to maintain the bands under tension.

FIG. 11 also shows means for ensuring that the lever 57 is moved fully to its lower position before being returned to its initial position during operation of the machine, as an alternative to the ratchet 82 and pawl 82*a* shown in FIG. 7. As shown in FIG. 11, a rack 138 is connected to the end of the lower band 132, between the band and the constant tension spring mechanism 135, and is slidable on the base of the housing in guide means 139 between the position shown in FIG. 11 when the lever is in its initial position, and a rearward position assumed when the lever is fully depressed. A pawl 140 is pivotally mounted above the rack and engages the teeth of the rack in such a way as to prevent reverse movement of the rack in either direction until the rack has first been moved to an end position in which the pawl is clear of the teeth at one or other end of the rack.

As described above, the handle 55 forms one end of, and is generally aligned with, the rest of the lever 57, the lever 57 extends through an elongate slot 56 extending over a substantial part of the height of the front wall of the housing 1, and the extent of angular movement of the lever 57 is limited by the height of the housing, generally to about 60°.

Figure 13:
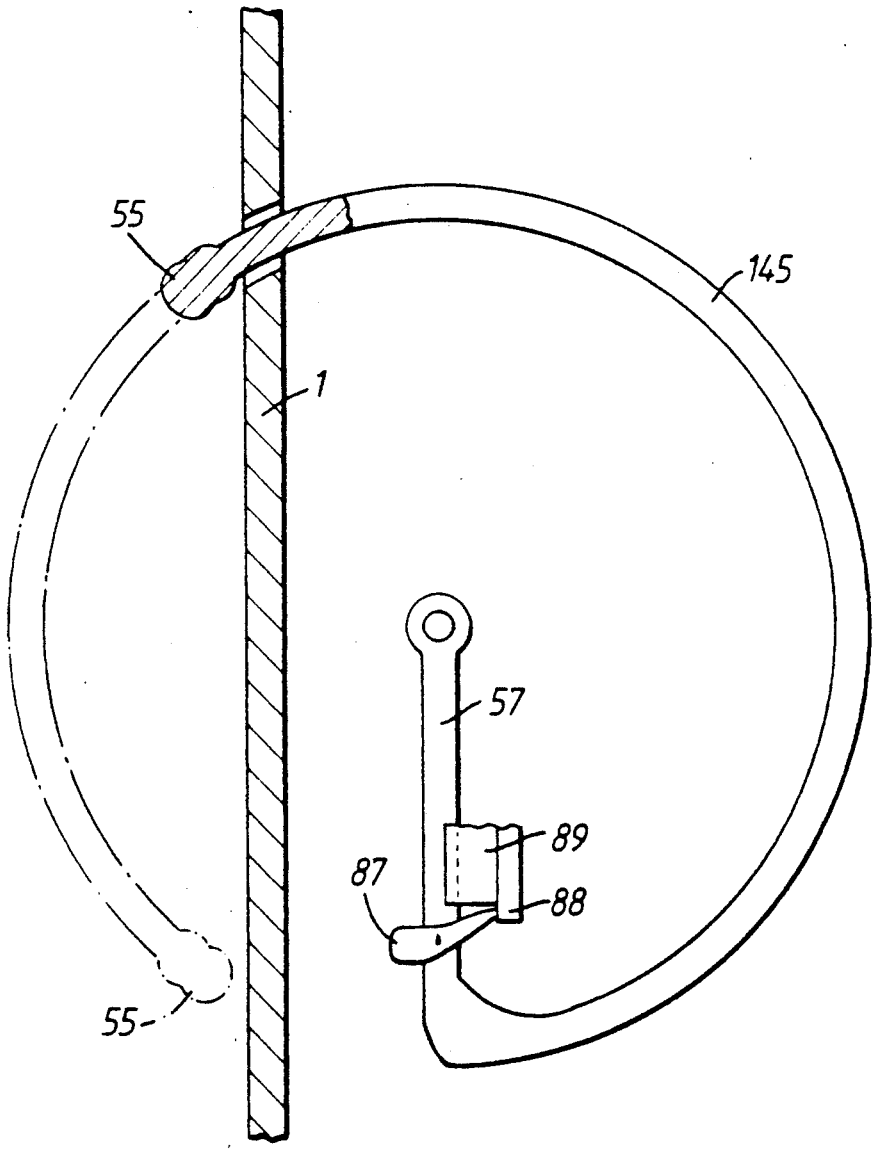
FIG. 13 is a diagrammatic part sectional part elevational view through the housing of an embodiment according to the invention showing a modified form of lever and handle.

In a modification shown in FIG. 13, the lever 57 is extended by an arcuate arm 145, the arc of the arm being centred on the axis of pivotal movement of the lever and the arm 145 terminates in the handle 55. The arm 145 extends through an opening 56*a* in the front wall of the housing 1.

In operation of the machine by the user with a lever and handle as shown in FIG. 13, once the mechanism has been freed, the handle 55 is pulled by the user outwardly and downwardly to the position shown in broken lines, to dispense an article. Because the arm 145 forms an arc, the location of its emergence from the housing 1 during movement of the lever remains unchanged so that opening 56*a* merely has to be dimensioned to accommodate the arm at its angle of emergence from the housing. No slot is required. Additionally, the maximum extent of angular movement of the lever 57 can be greater than in the arrangement of FIG. 7 and can be varied substantially by varying the position of the axis of the lever relative to the front wall of the housing. The maximum extent of angular movement can be just less than 180° and as shown it is about 120°. Increasing the angle through which the lever moves between its first and second positions has the result of reducing the speed at which the conveyors 5, 6 are moved during operation of the machine, for any one angular speed of rotation of the lever. This therefore reduces the speed at which the engagement means 17 of conveyor 6 engage an article and therefore reduces the risks of malfunction of the engagement means.

As indicated diagrammatically, the lever 57 may, as described with reference to FIG. *7a*, carry one or a plurality of keys 87 which pivot relative to the lever between a position, as shown, preventing movement of the lever and the dispensing of an article, and a position clear of abutment with stop 88 enabling the lever to move and an article to be dispensed.

It will be appreciated that the article feed system coupled to the lever 57 as shown in FIG. 13 can be as hereinbefore described but the intermediate drive mechanism coupling the lever 57 to the conveyors of the article feed system will require some modification in view of the repositioning of the axis of the lever towards the front of the housing.

It will be appreciated from the foregoing that the intermediate drive mechanism between the lever 57 and the article feed system may take any suitable and convenient form depending on the relative arrangements and dispositions of the lever 57 and the article feed system. Equally the other mechanisms for preventing operation of the machine in the absence of supply to the machine of the correct value of money may take a variety of different forms and act in a variety of different ways on the lever or the intermediate drive mechanism.

Although as described above, the article feed system is operated mechanically by the user, it may alternatively be powered electrically, hydraulically or pneumatically, the user connecting the power to drive the article feed system, e.g. by operation of a switch and/or by the supply of the correct amount of money to the machine.

There is thus provided a vending machine in which an article is positively conveyed by the article feed system to the outlet for removal therefrom by the user. The machine is capable of dispensing a variety of differently shaped and sized articles and any problems with the weight of the individual articles are avoided by arranging the articles in a horizontal array on the first conveyor.

What is claimed is:

1. A machine for dispensing generally planar articles such as newspapers comprising:

a housing having an outlet through which an article is dispensed, an article feed system comprising first and second conveyor means, said first conveyor means comprising a first movable conveying surface extending and movable in a first conveying direction towards said second conveyor means and for supporting an array of articles arranged generally vertically side by side in said first conveying direction, said second conveyor means being arranged to convey the leading article in the array in a second conveying direction transverse to said first conveying direction towards said outlet for removal therefrom, said second conveyor means comprising engagement means movable in said second conveying direction and adapted to positively engage the leading article in the array to move said article towards said outlet, said machine also comprising:

drive means for driving said article feed system, article retaining means for bearing against the last article in an array of articles on said first conveying surface for retaining the array upright on said conveying surface, and biassing means for biassing said article retaining means in the direction of said second conveyor means, said biassing means being independent of said first conveyor means.

2. A machine as claimed in claim 1 for supplying an article to a user in response to a predetermined value of money, comprising first releasable locking means for preventing operation of said article feed system, said first locking means being released in response to receipt by the machine of the predetermined value of money.

3. A machine as claimed in claim 2, wherein said first locking means comprise a pivotal element mounted for pivotal movement between a first position in which it prevents driving of said article feed system and a second position permitting driving of said article feed system by movement of said handle, said element being pivoted from its first position to its second position by money supplied to the machine.

4. A machine as claimed in claim 3, comprising a stop which is arranged to extend into the path of said pivotal element in its first position to prevent movement of said handle from its first position.

5. A machine as claimed in claim 1, wherein said engagement means comprise means for engaging a lateral edge of the leading article of said first conveyor means.

6. A machine as claimed in claim 1, wherein said engagement means comprising means for engaging in a surface of the leading article of said first conveyor means.

7. A machine as claimed in claim 1, wherein said first conveying direction is generally horizontal and said second conveying direction is generally perpendicular thereto.

8. A machine as claimed in claim 7, wherein said second conveying direction is generally horizontal.

9. A machine as claimed in claim 7, wherein said second conveying direction is generally vertically upward.

10. A machine as claimed in claim 1, wherein said drive means include a handle for operation by the user, means mounting the handle in the housing, said handle being movable from a first position to a second position in a first direction, and means coupling said handle to said article feed system such that movement of said handle in said first direction from said first position to said second position causes an article to be dispensed.

11. A machine as claimed in claim 10, wherein said handle is connected to or forms part of a lever and said lever is mounted in said housing for angular movement about a generally horizontal axis, rotation of said lever by movement of said handle in the first direction from its first position to its second position causing one article to be supplied to said outlet.

12. A machine as claimed in claim 10, wherein said coupling means comprises clutch means for transmitting drive to said article feed system only when said lever is moved in the first direction.

13. A machine as claimed in claim 1, comprising a removable cassette for containing a plurality of articles to be dispensed by the machine, said cassette being adapted to be received on said first conveyor means and to provide access for said first and second conveyor means to articles in the cassette for dispensing articles from the cassette.

14. A machine as claimed in claim 1, comprising means for sensing the presence of articles on said first conveyor means and for preventing operation of the machine in the absence of articles thereon.

15. A machine as claimed in claim 1, comprising:

user demand means manually operable externally of said housing for causing an article to be dispensed, money receiving means for receiving a predetermined value of money, and releasable means for preventing operation of said article feed system by operation of said user demand means to dispense an article and releasable in response to receipt of said predetermined value of money by said money receiving means.

16. A machine as claimed in claim 15, wherein said drive means comprises a handle for operation by the user and forming said user demand means, said handle being mounted in said housing for movement from a first position to a second position in a first direction, and means are provided for coupling said handle to said article feed system such that movement of said handle in said first direction from said first position to said second position causes an article to be dispensed when said releasable means is released.

17. A machine as claimed in claim 1, comprising:

a removable cassette for containing the array of articles to be received by said first conveyor means and to be dispensed by said machine, said cassette being adapted to be received in a fixed operative position within said housing and to provide access for said first and said second conveyor means to the articles in said cassette for moving the articles in said cassette relative to said cassette in said first conveying direction and for removing articles sequentially from said cassette in said second conveying direction.

18. A machine as claimed in claim 17, wherein said article retaining means and said biassing means are mounted on said cassette.

19. A machine for dispensing generally planar articles such as newspapers to a user comprising:

a housing having an outlet through which an article is delivered to the user, a user demand handle projecting from the housing and mounted for movement by the user from a first position to a second position in a first direction, an article feed system coupled to the handle to be driven by movement of the handle in the first direction, said article feed system comprising first and second conveyor means, said first conveyor means providing a movable first conveying surface extending and movable in a first generally horizontal conveying direction for receiving and supporting an array comprising a plurality of the articles thereon and for moving the articles towards an end thereof, the articles being arranged on said first conveying surface of said first conveyor means generally vertically side by side in said first conveying direction, and said second conveyor means extending from said end of said first conveying surface for engaging and conveying the leading article of the array from said end of said first conveying surface in a second generally horizontal conveying direction transverse to the first conveying direction towards said outlet for removal therefrom by the user, said second conveyor means comprising engagement means movable in said second conveying direction and adapted to positively engage the said leading article to move said article towards said outlet, article retaining means for bearing against the rearmost article in the array of articles on said first conveying surface for retaining the array of articles upright on said conveying surface, and biassing means for biassing said article retaining means in the direction of said second conveyor means, said biassing means being independent of said first conveyor means.

20. A machine as claimed in claim 19, comprising:

money receiving means for receiving a predetermined value of money, and releasable means for preventing operation of said article feed system by operation of said user demand means to dispense an article and releasable in response to receipt of said predetermined value of money by said money receiving means.

21. A machine as claimed in claim 19, comprising:

A removable cassette for containing the array of articles to be received by said first convey means an to be dispensed by said machine, said cassette being adapted to be received in a fixed operative position within said housing and to provide access for said first and said second conveyor means to the articles in said cassette for moving the articles in said cassette relative to said cassette in said first conveying direction and for removing articles sequentially from said cassette in said second conveying direction, said article retaining means and said biassing means being mounted on said cassette.

22. A machine for dispensing generally planar articles such as newspapers comprising:

a housing having an outlet through which an article is dispensed, an article feed system comprising first and second conveyor means, said first conveyor means comprising a first movable conveying surface extending and movable in a first conveying direction towards said second conveyor means and for supporting and moving an array of articles arranged generally vertically side by side in said first conveying direction towards the second conveyor means, said second conveyor means being arranged to convey the leading article in the array in a second generally horizontal conveying direction transverse to said first conveying direction towards said outlet for removal therefrom, said second conveyor means comprising engagement means movable in said second conveying direction and adapted to engage the leading article in the array to move said article towards said outlet, and drive means for driving said article feed system.

23. A machine as claimed in claim 22, comprising:

user demand means manually operable externally of said housing for causing an article to be dispensed, money receiving means for receiving a predetermined value of money, and releasable means for preventing operation of said article feed system by operation of said user demand means to dispense an article and releasably in response to receipt of said predetermined value of money by said money receiving means.

24. A machine as claimed in claim 23, wherein said drive means comprises a handle for operation by the user and forming said user demand means, said handle being mounted in said housing for movement from a first position to a second position in a first direction, and means are provided for coupling said handle to said article feed system such that movement of said handle in said first direction from said first position to said second position causes an article to be dispensed when said releasable means is released.

25. A machine for dispensing generally planar articles such as newspapers comprising:

a housing having an outlet through which an article is dispensed, user demand means manually operable externally of the housing for causing an article to be dispensed, an article feed system, means for driving said article feed system in response to operation of said user demand means, said article feed system comprising first and second conveyor means, said first conveyor means comprising a first movable conveying surface extending and movable in a first conveying direction towards said second conveyor means and for supporting and moving an array of the articles arranged generally vertically side by side in said first conveying direction towards the second conveyor means, said second conveyor means being arranged to convey the leading article in the array in a second generally horizontal conveying direction transverse to said first conveying direction towards said outlet for removal therefrom, said second conveyor means comprising engagement means movable in said second conveying direction and adapted to engage the leading article in the array to move said article towards said outlet.

26. A machine as claimed in claim 25, comprising:

money receiving means for receiving a predetermined value of money, and releasable means for preventing operation of said article feed system by operation of said user demand means to dispense an article and releasably in response to receipt of said predetermined value of money by said money receiving means, and wherein said drive means comprises a handle for operation by the user and forming said user demand means, said handle being mounted in said housing for movement from a first position to a second position in a first direction, and means are provided for coupling said handle to said article feed system such that movement of said handle in said first direction from said first position to said second position causes an article to be dispensed when said releasable means is released.

27. A machine for dispensing generally planar articles such as newspapers comprising:

a housing having an outlet through which an article is dispensed, an article feed system comprising first and second conveyor means, said first conveyor means being adapted to receive an array of the articles and to move the articles in a first conveying direction towards said second conveyor means, the articles being arranged relative to said first conveyor means generally vertically side by side in the first conveying direction, said second conveyor means being arranged to convey the leading one of the articles received by said first conveyor means in a second conveying direction transverse to the first conveying direction towards said outlet for removal therefrom, drive means for driving said article feed system, and a removable cassette for containing the array of articles to be received by said first conveyor means and to be dispensed by said machine, said cassette being received in a fixed operative position within said housing and providing access for said first and said second conveyor means to the articles in said cassette for moving the articles in said cassette relative to said cassette in said first conveying direction and for removing articles sequentially from said cassette in said second conveying direction.

28. A machine as claimed in claim 27, wherein said cassette has a leading end which in its operative position in said machine is positioned adjacent said second conveyor means, article retaining means are associated with said cassette for bearing against the rearmost article in said cassette remote from said leading end for retaining the array of articles in said cassette generally vertical and biassing means are provided on said cassette for biassing said article retaining means in the direction of said leading end of said cassette.

29. A machine as claimed in claim 27, comprising:

user demand means manually operable externally of said housing for causing an article to be dispensed, money receiving means for receiving a predetermined value of money, and releasable means for preventing operation of said article feed system by operation of said user demand means to dispense an article and releasable in response to receipt of said predetermined value of money by said money receiving means.

30. A machine as claimed in claim 29, wherein said drive means comprising a handle for operation by the user and forming said user demand means, said handle being mounted in said housing for movement from a first position to a second position in a first direction, and means are provided for coupling said handle to said article feed system such that movement of said handle in said first direction from said first position to said second position causes an article to be dispensed when said releasable means is released.

* * * * *